US007284683B2

(12) United States Patent
Benivay et al.

(10) Patent No.: US 7,284,683 B2
(45) Date of Patent: Oct. 23, 2007

(54) DEVICE FOR DISPENSING A PRODUCT

(75) Inventors: Philippe Benivay, Eaubonne (FR); Gaëtane Leboube, Paris (FR)

(73) Assignee: L'Oreal S.A. (FR)

( * ) Notice: Subject to any disclaimer, the term of this patent is extended or adjusted under 35 U.S.C. 154(b) by 505 days.

(21) Appl. No.: 10/869,916

(22) Filed: Jun. 18, 2004

(65) Prior Publication Data

US 2005/0040187 A1 Feb. 24, 2005

Related U.S. Application Data

(60) Provisional application No. 60/485,121, filed on Jul. 8, 2003.

(30) Foreign Application Priority Data

Jun. 20, 2003 (FR) ..... 03 07516
Jun. 27, 2003 (FR) ..... 03 07801

(51) Int. Cl.
*B65D 83/22* (2006.01)

(52) U.S. Cl. ..... 222/402.11; 222/321.8; 222/401; 222/320

(58) Field of Classification Search ..... 222/402.11–402.13, 402.1, 321.7–321.9, 222/321.1, 320, 401, 573; 239/337, 338
See application file for complete search history.

(56) References Cited

U.S. PATENT DOCUMENTS 2,766,913 A * 10/1956 Wilshusen ..... 222/402.22
RE24,599 E * 2/1959 Campbell ..... 222/402.13
2,941,700 A * 6/1960 Gable ..... 222/402.15
3,104,034 A 9/1963 Sagarin et al.
3,611,820 A * 10/1971 Hempel ..... 74/102
5,392,962 A * 2/1995 Meshberg ..... 222/321.8
6,371,337 B2 * 4/2002 Garcia et al. ..... 222/385

FOREIGN PATENT DOCUMENTS

| | | |
|---|---|---|
| EP | 0 625 376 | 11/1994 |
| FR | 1 308 089 | 11/1962 |
| GB | 228 000 | 1/1925 |

OTHER PUBLICATIONS

English language Derwent Abstract of EP 0 625 376, Nov. 23, 1994.

* cited by examiner

*Primary Examiner*—J. Casimer Jacyna
(74) *Attorney, Agent, or Firm*—Finnegan, Henderson, Farabow, Garrett & Dunner, LLP

(57) ABSTRACT

A device for dispensing a product may include a stationary portion, a pushbutton configured to move relative to the stationary portion and to be actuated to cause dispensing of a product, and a spring. The spring may include an assembly portion configured to associate the spring and the stationary portion with one another. The assembly portion may include at least one turn. The spring may further include a projecting portion configured to extend substantially along at least a portion of the pushbutton.

46 Claims, 3 Drawing Sheets

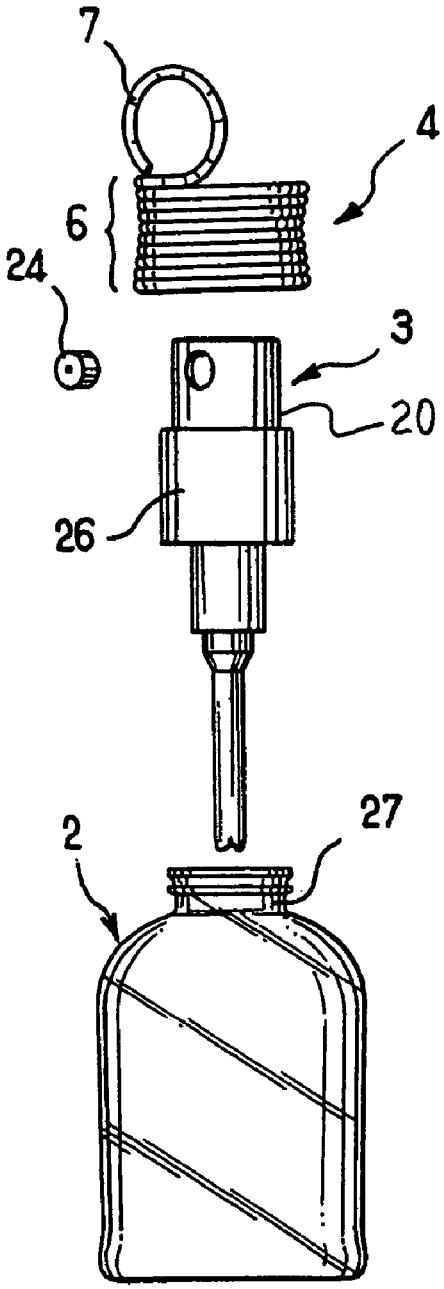
FIG.13
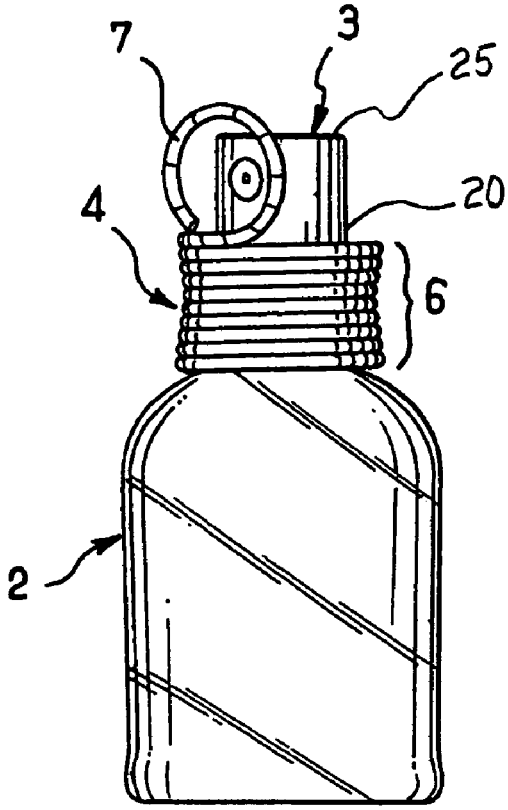
FIG.12
FIG.14

DEVICE FOR DISPENSING A PRODUCT

This application claims the benefit of priority under 35 U.S.C. § 119(e) of U.S. provisional application No. 60/485,121, filed on Jul. 8, 2003.

BACKGROUND OF THE INVENTION

1. Field of the Invention

The present invention relates to devices for dispensing products (e.g., cosmetic products and/or care products). For example, the devices may be used to apply cosmetic products such as those defined in Counsel Directive 93/35/EEC (European Economic Community) dated Jun. 14, 1993, which provides one non-limiting, exemplary definition of cosmetic products. (Other definitions are also possible.)

2. Description of the Related Art

Numerous products, for example, perfumes, are packaged in flasks fitted with a pump that enables the product to be dispensed in the form of a spray. The pump may include a pushbutton provided with a nozzle. A cap may be fixed to the flask such that the cap covers the pushbutton in order to help protect against the pushbutton being accidentally depressed, for example, when the flask is transported in a handbag. One possible drawback of such a cap may be that it becomes an additional part of the packaging that may be lost. A further drawback of a cap is that it may require the user to remove and replace the cap each time the dispenser is used.

There may exist a need to reduce the risk of the pushbutton being accidentally depressed, for example, while a flask is being transported, without excessively complicating manufacture of the flask or being detrimental to the appearance of the flask.

The invention, for example, may seek to satisfy the above-mentioned need.

Although the present invention may obviate the above-mentioned need, it should be understood that some aspects of the invention might not necessarily obviate that need.

SUMMARY OF THE INVENTION

In the following description, certain aspects and embodiments will become evident. It should be understood that the invention, in its broadest sense, could be practiced without having one or more features of these aspects and embodiments. It should be understood that these aspects and embodiments are merely exemplary.

In one aspect, as embodied and broadly described herein, the invention includes a device for dispensing a product that may include a stationary portion, a pushbutton configured to move relative to the stationary portion and to be actuated to cause dispensing of a product, and a spring comprising an assembly portion configured to associate the spring and the stationary portion with one another. The assembly portion may include at least one turn. The spring may further include a projecting portion configured to extend substantially along at least a portion of the pushbutton.

The term "pushbutton" as used herein means any actuator member that the user can press in order to cause a quantity of product to be dispensed.

The term "spring" as used herein means any part(s) having relatively small capacity for elastic deformation.

The term "along" as used herein means on a line or course parallel and close to.

According to another aspect, the device may include the product and the product may include a cosmetic product.

In yet another aspect, the projecting portion of the spring may (or may not) serve to reduce the risk of the pushbutton being depressed accidentally. The capacity of the spring to deform elastically may render it relatively easier to mount the spring on the stationary portion and may confer a certain amount of strength to the projecting portion.

According to a further aspect, the spring may be configured to be removably affixed to the stationary portion, which may, for example, enable the user to replace the spring with a cap and/or to reuse the spring on another flask. According to yet another aspect, the spring and the stationary portion may be configured such that the assembly portion and the stationary portion are affixed to one another sufficiently tightly to substantially prevent the spring from being removed by a user exerting a pulling force on the projecting portion.

In yet another aspect, the pushbutton may define a length and the projecting portion may extend a distance greater than the length of the pushbutton, for example, so as to project beyond it.

In still a further aspect, the assembly portion may include a plurality of turns and/or at least some of the turns may touch at least one of the other turns, for example, depending on a desired appearance effect.

In a further aspect, the spring may include metal wire, for example, formed from a filament. For example, the spring may be formed from a spring steel wire having a circular or other cross-section. For example, the spring may have a square-shaped or rectangular-shaped cross-section, which may be a function of, for example, the desired appearance.

According to yet another aspect, the assembly portion may include a plurality of turns, and at least some of the turns may define differing shapes when viewed in a direction substantially parallel to an axis of the turns (e.g., viewed from above). Alternatively, or in addition, the assembly portion may include a plurality of turns defining substantially the same cross-section when viewed in a direction substantially parallel to an axis of the turns (e.g., viewed from above). According to some aspects, diameters of the turns may differ if the turns are substantially circular. A substantially circular spiral shape may permit the assembly portion to turn relative to the stationary portion, for example, to allow the user to orient the projecting portion relative to a substance-dispensing nozzle present in the pushbutton. The spring, in particular, the spring's assembly portion, need not include a purely helical winding.

According to a further aspect, the diameters of the turns of a succession of turns may pass through a single extremum, and the extremum may be either a minimum or a maximum. The assembly portion may include, for example, at least one winding defining a frustoconical envelope, for example, two successive windings, each defining a frustoconical envelope being disposed in such a manner so as to define a substantially hourglass-shaped assembly portion. According to some aspects, the assembly portion may define an envelope, for example, that is substantially conical, spherical, or cylindrical.

In still another aspect, the pushbutton may be configured to move along an axis, and the assembly portion may extend along a longitudinal axis that substantially coincides with the axis.

According to another aspect, the at least one turn of the assembly portion may define an axis, and the projecting portion may include a turn defining an axis oriented at an angle with respect to the axis of the assembly portion. For example, the turn of the projecting portion may include a single turn and the angle may be substantially 90 degrees.

In still a further aspect, the projecting portion may be, for example, in the form of a single turn. The turn may be connected directly to an adjacent turn of the assembly portion (e.g., when the projecting portion and the projecting portion may be defined by a single piece of material), although the projecting portion turn could be disposed in an alternative way. The projecting portion turn may be connected to, for example, at least one turn other than a turn situated at one end of the assembly portion.

In another aspect, the at least one turn of the assembly portion may define a section when viewed in a direction substantially parallel to an axis of the at least one turn of the assembly portion, and the turn of the projecting portion may define a section when viewed in a direction parallel to an axis of the projecting portion turn that is smaller than the section of the at least one turn of the assembly portion. The section of the projecting portion turn and its position relative to the pushbutton may be selected such that when the pushbutton includes a spray dispenser nozzle, the spray emitted by the nozzle does not encounter the turn. The center of the turn, for example, may lie substantially in registration with the nozzle at about the halfway point of an actuation stroke of the pushbutton.

According to one aspect, the device may include a flask defining a neck and a pump fixed to the neck via at least one of crimping and snap-fastening. The flask may be formed of, for example, glass.

In still another aspect, the device may include a hoop fixed to at least one of the neck and the pump of the flask. According to another aspect, the spring and the hoop may be snap-fastened to one another. The hoop may include, for example, an annular bead configured to allow at least one turn of the assembly portion to go past the annular bead, for example, via elastic deformation of the assembly portion. The annular bead may be positioned, for example, so as to be situated substantially between two turns of the assembly portion once the assembly portion of the spring is mounted on the hoop. In still a further aspect, the hoop may include a base and a collar at the base, and the one end of the assembly portion and the collar may be configured to bear against one another. The collar may define a groove, and the hoop may house a ring configured to be inserted in the groove. The hoop may include metal, and the ring may include plastics material.

According to a further aspect, the assembly portion may include a face defining a substantially planar portion configured to rest against the collar. The substantially planar portion may be formed, for example, via grinding.

In still another aspect, the device may include a pump including an assembly skirt configured to be snap-fastened to a neck of a flask. According to some aspects, the assembly portion may be fixed directly to the assembly skirt.

According to yet another aspect, a device for dispensing a product may include a receptacle defining an opening and containing the product, a dispenser element associated with the opening, a dispenser head defining at least one outlet orifice and including a stationary portion and a pushbutton configured to move relative to the stationary portion. The pushbutton may be configured to actuate the dispenser element and cause delivery of a portion of the product to the at least one outlet orifice. The device may further include a member configured in the form of a winding and including at least a first turn substantially occupying a plane and configured to be fixed to the stationary portion of the dispenser head, and at least a second turn extending substantially in a plane that is not parallel to the plane of the first turn and having a portion that extends to or beyond an actuator surface of the pushbutton.

In still a further aspect, the dispenser element may include at least one of a pump and a valve.

In yet another aspect, the second turn may extend beyond the actuator surface of the pushbutton.

According to a further aspect, a device for dispensing a product may include a stationary portion, a pushbutton configured to move relative to the stationary portion and to be actuated to cause dispensing of product, and a spring including an assembly portion configured to associate the spring and the stationary portion with one another. The assembly portion may include at least one turn, and the spring may further include a projecting portion. The at least one turn of the assembly portion may define an axis, and the projecting portion may include a turn defining an axis oriented at an angle with respect to the axis of the assembly portion.

In yet another aspect, a device for dispensing a product may include a stationary portion and a pushbutton defining an actuator surface. The pushbutton may be configured to move relative to the stationary portion and to be actuated to cause dispensing of product. The device may further include a spring including an assembly portion configured to associate the spring and the stationary portion with one another. The assembly portion may include at least one turn, and the spring may further include a projecting portion extending from the assembly portion to or beyond the actuator surface.

Aside from the structural arrangements set forth above, the invention could include a number of other arrangements, such as those explained hereinafter. It is to be understood, that both the foregoing description and the following description are exemplary.

BRIEF DESCRIPTION OF THE DRAWINGS

The accompanying drawings are incorporated in and constitute a part of this specification. The drawings illustrate exemplary embodiments of the invention and, together with the description, serve to explain some principles of the invention. In the drawings.

FIG. 12 is schematic elevation view of another embodiment of a device;

FIG. 13 is schematic assembly view of the device of FIG. 12; and

FIG. 14 is a schematic cross-section view of one embodiment of a spring.

DESCRIPTION OF EMBODIMENTS

Figure 1:
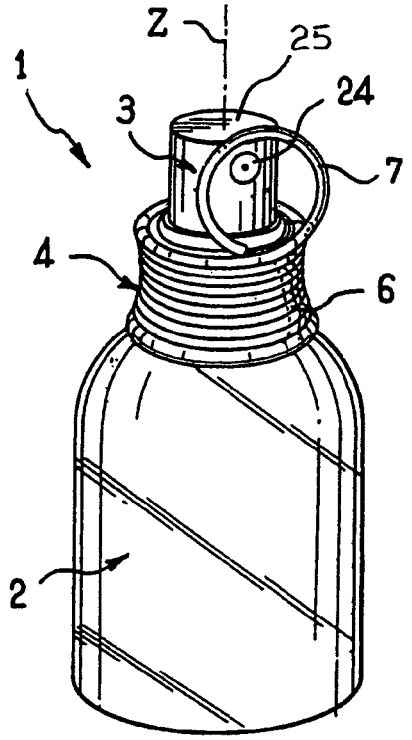
FIG. 1 is a schematic perspective view of an embodiment of a device for dispensing a product.

Reference will now be made in detail to some possible embodiments of the invention, examples of which are illustrated in the accompanying drawings. Wherever possible, the same reference numbers are used in the drawings and the description to refer to the same or like parts.

Figure 2:
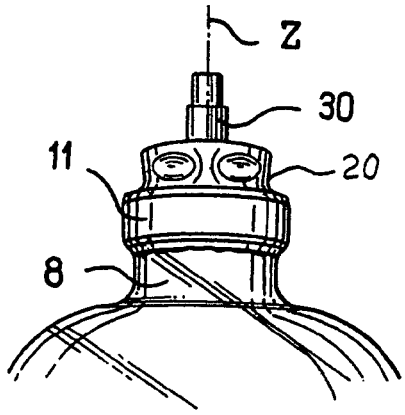
FIG. 2 is a partial, schematic elevation view of one embodiment of a portion of a device.
Figure 4:
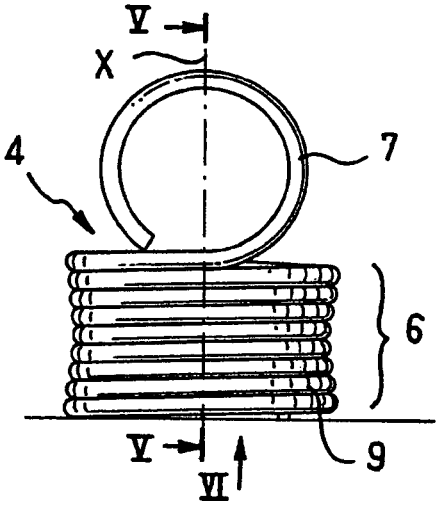
FIG. 4 is a schematic elevation view of the spring of FIG. 3.
Figure 3:
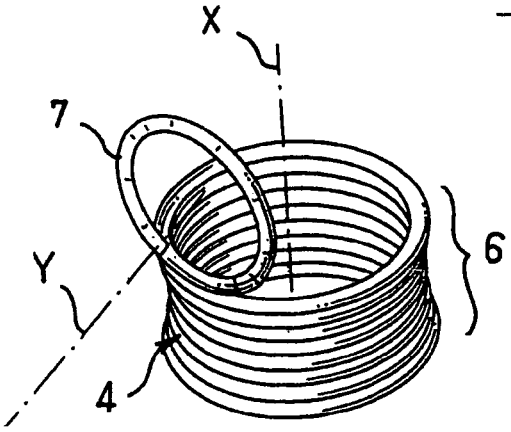
FIG. 3 is a schematic perspective view of one embodiment of a spring.
Figure 5:
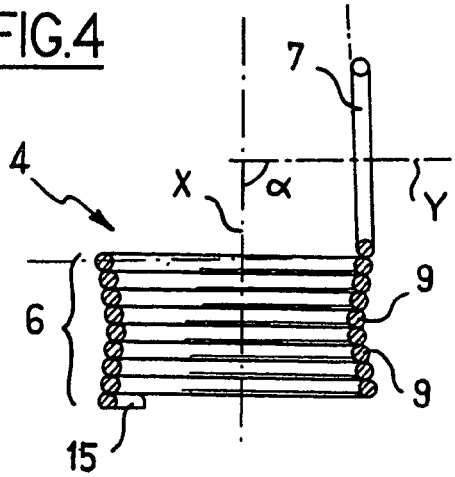
FIG. 5 is a section view along line V-V of FIG. 4.
Figure 6:
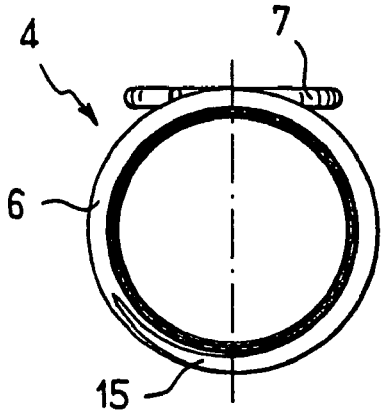
FIG. 6 is a view along VI of FIG. 4.

FIG. 1 depicts an exemplary embodiment of a device 1 for dispensing a product. The device 1 includes a fixed portion including a receptacle 2 that may be a flask that may be formed of, for example, glass and/or plastics material, and that may include a neck 8, for example, as shown in FIG. 2. A hoop 5 may be held via friction on the neck 8. The device 1 may also include a moving portion, such as, for example, a pushbutton 3 of a pump 20 that may be inserted in the neck 8 and that may include a rod 30, for example, as shown in FIG. 2. The neck 8 may include an annular bead 12 (see, e.g., FIG. 7) against which a metal capsule 11 may be crimped, for example, for fixing the body of the pump 20 to the flask 2.

A spring 4 may cover at least a portion of the hoop 5, and the spring 4 may include an assembly portion 6 for fixing the spring 4 onto the hoop 5. The spring 4 may also include a projecting portion 7 that may project beyond (e.g., above) the pushbutton 3 (e.g., above an actuator surface 25 that a user presses to cause pushbutton actuation). The assembly portion 6 and projecting portion 7 may be formed from a single piece of material, for example, via shaping a steel metal wire having, for example, a substantially circular cross-section. The wire may be subjected to heat treatment, for example, so as to give it color (e.g., a bluish color), and/or the wire may be polished so as to give it a shiny appearance.

The pushbutton 3 may define an actuator surface 25, which may be moved along an axis Z that may substantially coincide, for example, with a longitudinal axis of the flask 2. As can be seen more particularly in FIGS. 3 through 6, for example, the projecting portion 7 may be in the form of a single turn that is substantially circular and substantially planar in shape, for example, having an axis Y that is at an angle $\alpha$ of about 90 degrees relative to the axis X of the assembly portion 6.

According to some exemplary embodiments, the assembly portion 6 may include a plurality of turns 9 defining a succession of turns 9, at least some of which may touch one another, and each of which may be substantially circular-shaped. The diameters of the turns 9 may initially decrease and then increase as viewed along the axis X from the turn adjacent to turn 7 toward the opposite end of the succession of turns 9, so that the inside diameter of the assembly portion 6, for example, passes through a minimum diameter substantially halfway along the succession of turns 9. The inside diameter of the turns 9 of the assembly portion 6 may, for example, be selected as a function of the degree of force desired for clamping the spring 4 on the hoop 5.

Figure 7:
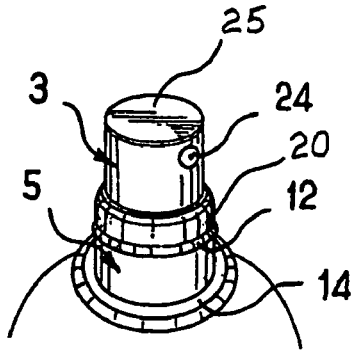
FIG. 7 is a schematic perspective view of a portion of one embodiment of a device in one configuration.
Figure 8:
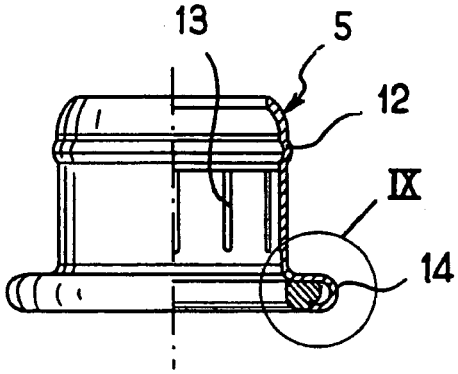
FIG. 8 is a partial, schematic cross-section view of one embodiment of a hoop.
Figure 9:
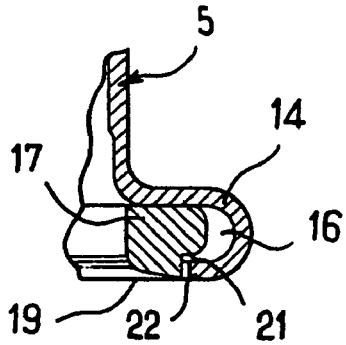
FIG. 9 is a view of detail IX of FIG. 8.

The hoop 5 may be formed from, for example, a sheet of metal via at least one stamping operation, and the hoop 5 may include, for example, as depicted in FIGS. 7 and 8, an annular bead 12 defining a portion in relief onto which the assembly portion 6 of the spring 4 may be snap-fastened. The annular bead 12 may be capable of, for example, being received in a groove that is formed between two adjacent ones of the turns 9. The hoop 5 may include longitudinal ribs 13 on its radially inner surface so as frictionally contact the capsule 11. At its base, the hoop 5 may include a collar 14 defining, for example, an inwardly folded bottom rim 22. The spring 4 may press via its bottom face 15 against the collar 14. The bottom face 15 may be ground, for example, such that it defines a substantially planar surface that is substantially perpendicular to the axis X, for example, so as to enable the bottom face 15 to rest against the collar 14 over substantially all of its circumference.

Figure 10:
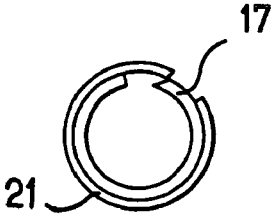
FIG. 10 is a schematic plan view of a portion of one embodiment of a device.

The collar 14 may define an inwardly-open groove 16 configured to receive a ring 17 (e.g., a split ring), for example, as shown in FIG. 10. The ring 17 may define a shouldered annular portion 21 configured to engage the groove 16 above the bottom rim 22 of the collar 14. The ring 17 may serve to stiffen the collar 14 and substantially maintain its dimensions, and the ring 17 may also contribute to centering the hoop 5 on the pump 20 during manufacture of the device 1. In the exemplary embodiment depicted in FIG. 10, the ring 17 defines a bottom face 19 that is slightly conical (i.e., flaring downward and outward), and that is suitable for bearing against a shoulder located at or near the base of the neck 8 of the flask 2, thus enabling the ring 17 to act as a shock absorber when the hoop 9 is mounted on the flask 2, for example, in the event that the hoop 5 is pushed down onto the neck 8 of the flask 2 with too much force.

Figure 11:
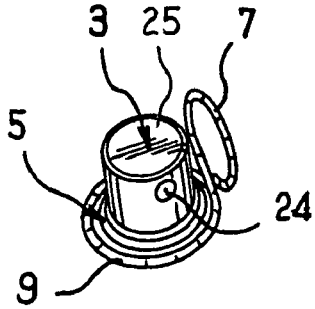
FIG. 11 is a schematic perspective view of a portion of one embodiment of a device in one configuration.

According to some embodiments, the pushbutton 3 includes a nozzle 24 configured to dispense product in the form of a spray. While the spring 4 is placed on the hoop 5, the turn 7 may be positioned facing the nozzle 24, for example, so to render it possible to spray the product through opening defined by the turn 7. According to some embodiments, the user may be able to selectively offset the turn 7 relative to the nozzle 24 (e.g., as shown in FIG. 11), for example, if the degree of clamping force between the assembly portion 6 and the hoop 5 allows the user to turn the assembly portion 6 of the spring 4 with respect to the hoop 5. According to some embodiments, the turn 7 may extend beyond the pushbutton 3, and may serve to prevent, at least to some extent, the pushbutton 3 from being accidentally depressed, for example, by items in a handbag and/or the walls of the handbag.

According to some embodiments, the device 1 may be configured without a hoop 5, for example, by fixing the spring 4 directly to at least one of the pump 20 and the neck 5 of the flask 2. For example, FIGS. 11 and 12 depict an exemplary embodiment in which the pump 20 includes an assembly skirt 26 configured to be, for example, snap-fastened on a relief portion 27 of the neck 5 of the flask 2, and in which the spring 4 may be configured to be fixed directly to the skirt 26. Such a configuration can render it relatively easier to make, for example, a relatively smaller size device 1.

The spring 4 may be formed of wire, for example, defining various cross-sectional shapes that may be either uniform throughout the extent of the wire or that may vary with location along the extent of the wire. For example, FIG. 14 depicts a wire for a spring 4 that has a substantially square-shaped cross-section at least one point along the extent of the wire.

According to some embodiments, a valve may be used instead of, or in addition to, a pump 20, and the product may be contained under pressure in the flask 2 (e.g., under pressure in a receptacle).

The device according to some exemplary embodiments of the invention may be used to apply cosmetic products and/or care products, such as make-up products, dermatological substances, and/or pharmaceutical compositions used for treating and/or changing the appearance and/or scent. However, in its broadest aspects, the present invention could be used to apply many other products and/or substances.

Furthermore, sizes of various structural parts and materials used to make the above-mentioned parts are illustrative and exemplary only, and one of ordinary skill in the art would recognize that these sizes and materials can be changed to produce different effects or desired characteristics.

It will be apparent to those skilled in the art that various modifications and variations can be made to the structure of the present invention. Thus, it should be understood that the invention is not limited to the examples discussed in the specification. Rather, the present invention is intended to cover modifications and variations.

What is claimed is:

1. A device for dispensing a product, the device comprising:

a stationary portion;

a pushbutton configured to move relative to the stationary portion and to be actuated to cause dispensing of a product; and a spring comprising an assembly portion configured to associate the spring and the stationary portion with one another, the assembly portion comprising at least one complete turn encircling the stationary portion, and a projecting portion configured to extend substantially along at least a portion of the pushbutton, wherein the spring extends outside the pushbutton.

2. The device of claim 1, wherein the device further comprises the product, and wherein the product comprises a cosmetic product.

3. The device of claim 1, wherein the pushbutton defines a length and the projecting portion extends a distance greater than the length of the pushbutton.

4. The device of claim 1, wherein the spring is configured to be removably affixed to the stationary portion.

5. The device of claim 1, wherein the spring and the stationary portion are configured such that the assembly portion and the stationary portion are affixed to one another sufficiently tightly to substantially prevent the spring from being removed by a user exerting a pulling force on the projecting portion.

6. The device of claim 1, wherein the assembly portion comprises a plurality of turns.

7. The device of claim 6, wherein at least some of the turns touch at least one of the other turns.

8. The device of claim 6, wherein the turns are one of substantially circular-shaped and substantially elliptical-shaped when viewed in a direction substantially parallel to an axis of the turns.

9. The device of claim 1, wherein the spring comprises metal wire.

10. The device of claim 1, wherein the spring comprises wire having a cross-section that is one of substantially circular and substantially square.

11. The device of claim 1, wherein the assembly portion comprises a plurality of turns, at least some of the turns defining differing shapes when viewed in a direction substantially parallel to an axis of the turns.

12. The device of claim 11, wherein the assembly portion comprises a succession of turns having a diameter when viewed in a direction substantially parallel to an axis of the turns that varies starting from one end of the assembly portion to another end of the assembly portion.

13. The device of claim 12, wherein the diameters of the turns of the succession of turns pass through a single extremum.

14. The device of claim 13, wherein the extremum is a minimum.

15. The device of claim 1, wherein the pushbutton is configured to move along an axis, and wherein the assembly portion extends along a longitudinal axis that substantially coincides with the axis.

16. The device of claim 1, wherein the at least one turn of the assembly portion defines an axis, and the projecting portion comprises a turn defining an axis oriented at an angle with respect to the axis of the assembly portion.

17. The device of claim 16, wherein the turn of the projecting portion comprises a single turn.

18. The device of claim 16, wherein the angle is substantially 90 degrees.

19. The device of claim 16, wherein the at least one turn of the assembly portion defines a section when viewed in a direction substantially parallel to an axis of the at least one turn of the assembly portion, and the turn of the projecting portion defines a section when viewed in a direction parallel to an axis of the projecting portion turn that is smaller than the section of the at least one turn of the assembly portion.

20. The device of claim 1, further comprising a flask defining a neck and a pump fixed to the neck via at least one of crimping and snap-fastening.

21. The device of claim 20, further comprising a hoop fixed to at least one of the neck and the pump of the flask.

22. The device of claim 21, wherein the spring and the hoop are snap-fastened to one another.

23. The device of claim 21, wherein the hoop comprises metal.

24. The device of claim 21, wherein the hoop comprises a base and a collar at the base, wherein the one end of the assembly portion and the collar are configured to bear against one another.

25. The device of claim 24, wherein the assembly portion comprises a face defining a substantially planar portion configured to rest against the collar.

26. The device of claim 25, wherein the substantially planar portion is formed via grinding.

27. The device of claim 24, wherein the collar defines a groove, and the hoop houses a ring configured to be inserted in the groove.

28. The device of claim 27, wherein the ring comprises plastics material.

29. The device of claim 1, further comprising a pump comprising an assembly skirt configured to be snap-fastened to a neck of a flask.

30. The device of claim 29, wherein the assembly portion is fixed directly to the assembly skirt.

31. A device for dispensing a product, the device comprising:

a receptacle defining an opening and containing the product;

a dispenser element associated with the opening;

a dispenser head defining at least one outlet orifice and comprising a stationary portion and a pushbutton configured to move relative to the stationary portion, the pushbutton being configured to actuate the dispenser element and cause delivery of a portion of the product to the at least one outlet orifice; and a member configured in the form of a winding and comprising at least a complete first turn substantially occupying a plane and configured to be fixed to and encircle the stationary portion of the dispenser head, and at least a second turn extending substantially in a plane that is not parallel to the plane of the first turn and having a portion that extends to or beyond an actuator surface of the pushbutton.

32. The device of claim 31, wherein the product comprises a cosmetic product.

33. The device of claim 31, wherein the dispenser element comprises at least one of a pump and a valve.

34. The device of claim 31, wherein the second turn extends beyond the actuator surface of the pushbutton.

35. A device for dispensing a product, the device comprising:

a stationary portion;

a pushbutton configured to move relative to the stationary portion and to be actuated to cause dispensing of product; and a spring comprising an assembly portion configured to associate the spring and the stationary portion with one another, the assembly portion comprising at least one complete turn encircling the stationary portion, and a projecting portion, wherein the at least one turn of the assembly portion defines an axis, and the projecting portion comprises a turn defining an axis oriented at an angle with respect to the axis of the assembly portion, so that a plane in which the turn of the assembly portion extends and a plane in which the turn of the projecting portion extends are not parallel to one another.

36. The device of claim 35, wherein the device further comprises the product, and wherein the product comprises a cosmetic product.

37. The device of claim 35, wherein the angle is substantially 90 degrees.

38. The device of claim 35, wherein the pushbutton defines a length and the projecting portion extends a distance greater than the length of the pushbutton.

39. The device of claim 35, wherein the projecting portion comprises a single turn.

40. The device of claim 35, wherein the spring extends outside the pushbutton.

41. A device for dispensing a product, the device comprising:

a stationary portion;

a pushbutton defining an actuator surface, the pushbutton being configured to move relative to the stationary portion and to be actuated to cause dispensing of product; and a spring comprising an assembly portion configured to associate the spring and the stationary portion with one another, the assembly portion comprising at least one complete turn encircling the stationary portion, and a projecting portion extending from the assembly portion to or beyond the actuator surface.

42. The device of claim 41, wherein the device further comprises the product, and wherein the product comprises a cosmetic product.

43. The device of claim 41, wherein the projecting portion extends beyond the actuator surface.

44. The device of claim 41, wherein the at least one turn of the assembly portion defines an axis, and the projecting portion comprises a turn defining an axis oriented at an angle with respect to the axis of the assembly portion.

45. The device of claim 44, wherein the turn of the projecting portion comprises a single turn.

46. The device of claim 44, wherein the angle is substantially 90 degrees.

* * * * *

UNITED STATES PATENT AND TRADEMARK OFFICE

CERTIFICATE OF CORRECTION

PATENT NO. : 7,284,683 B2
APPLICATION NO. : 10/869916
DATED : October 23, 2007
INVENTOR(S) : Philippe Benivay et al.

It is certified that error appears in the above-identified patent and that said Letters Patent is hereby corrected as shown below:

On the Title Page, item (73), "L'Oreal" should read --L'Oréal--.

Signed and Sealed this

First Day of April, 2008

JON W. DUDAS
*Director of the United States Patent and Trademark Office*